US006232888B1

(12) United States Patent
Davis et al.

(10) Patent No.: US 6,232,888 B1
(45) Date of Patent: May 15, 2001

(54) TRAFFIC PAGING SYSTEM

(75) Inventors: Steven J. Davis, Hermosa Beach; Gordon E. Kaiser, San Juan Capistrano, both of CA (US)

(73) Assignee: Cue Corporation, Irvine, CA (US)

( * ) Notice: Subject to any disclaimer, the term of this patent is extended or adjusted under 35 U.S.C. 154(b) by 0 days.

(21) Appl. No.: 09/455,614

(22) Filed: Dec. 7, 1999

(51) Int. Cl.[7] ..... G08G 1/09
(52) U.S. Cl. ..... 340/905; 340/996
(58) Field of Search ..... 340/905, 988, 340/990, 996, 992, 994, 995, 989; 701/200, 207, 208, 212, 117; 379/209; 455/456, 575, 517, 186.1

(56) References Cited

U.S. PATENT DOCUMENTS

| | | | | |
|---|---|---|---|---|
| 4,006,447 | | 2/1977 | Narbaits-Jaureguy et al. | 340/901 |
| 4,812,843 | * | 3/1989 | Champion, III et al. | 340/905 |
| 4,887,308 | | 12/1989 | Dutton | 455/156.1 |
| 5,131,020 | * | 7/1992 | Liebesny et al. | 340/905 |
| 5,193,214 | | 3/1993 | Mardus et al. | 455/186.1 |
| 5,572,201 | | 11/1996 | Graham et al. | 340/902 |
| 5,719,771 | * | 2/1998 | Buck et al. | 340/988 |
| 5,774,827 | | 6/1998 | Smith, Jr. et al. | 701/209 |
| 5,808,566 | | 9/1998 | Behr et al. | 340/995 |
| 5,835,026 | | 11/1998 | Wicks et al. | 340/905 |
| 5,848,373 | * | 12/1998 | DeLorme et al. | 340/995 |
| 5,850,190 | | 12/1998 | Wicks et al. | 340/905 |
| 5,864,305 | | 1/1999 | Rosenquist | 340/905 |
| 5,884,216 | | 3/1999 | Shah et al. | 701/207 |

* cited by examiner

*Primary Examiner*—Van T. Trieu
(74) *Attorney, Agent, or Firm*—Lyon & Lyon LLP

(57) ABSTRACT

A traffic paging system for audibly disseminating real-time traffic information and methods of manufacturing and using the same. The traffic paging system comprises a route-entry system, a receiver system, and an audio system. The route-entry system permits a user to specify one or more preselected routes. After receiving the real-time traffic information, the receiver system converts a relevant portion of the real-time traffic information that is specific to the preselected routes into audio traffic information. The audio system then audibly presents the audio traffic information to the user.

11 Claims, 2 Drawing Sheets

TRAFFIC PAGING SYSTEM

BACKGROUND OF THE INVENTION

1. Field of the Invention

The present invention relates generally to wireless messaging systems and, more particularly, to a wireless messaging system providing audible real-time, route-specific information, including weather as well as actual and potential traffic conditions.

2. Background of the Invention

Traffic congestion has become a commuter's biggest headache. As society has grown more mobile, the number of vehicles clogging our roads has dramatically increased, resulting in longer commute times and frustrated commuters. This congestion has many causes, including traffic hazards, vehicle accidents, road construction and maintenance, and volumes of traffic that overwhelm the capacity of the highway system.

Due to the continuing severity of this problem, many commuters take precautions before and during their commutes to avoid this congestion. For example, many commuters listen to television stations or access Internet sites that provide local traffic and weather information. Armed with this information, these commuters hope to avoid any unnecessary delays on the highway. Since traffic and weather conditions are changing constantly, however, the information that the commuters receive from these sources may quickly become inaccurate during their commute. To keep drivers current on dynamic highway conditions, commercial radio stations also broadcast traffic and weather information to assist commuters as they drive. But, although these radio stations provide frequent updates, this information is provided only at limited intervals. Further, each update encompasses only small portions of a larger geographic area.

Commuters may also be kept informed of changing traffic and weather conditions through the use of mobile traffic pagers that provide route-specific information. For example, U.S. Pat. No. 5,850,190, issued to Wicks, the disclosure of which is incorporated herein by reference, describes a traffic information pager for receiving and visually displaying traffic information through the use of icons on a map. The traffic information pager under this patent compares incoming traffic information with a preselected route and displays any relevant information with the icons indicating the location, type, and severity of an actual or potential traffic problem. Similarly, U.S. Pat. No. 5,835,026, also issued to Wicks, the disclosure of which is incorporated herein by reference, describes a commuter information pager that visually displays incoming traffic reports.

In operation, a service provider for a paging system compiles information regarding the weather and actual or potential traffic problems from commercial sources or by scanning the emergency service frequencies. Commuters who subscribe to the paging system each provide the service provider with a description of one or more preselected routes and, in return, receive a mobile traffic pager with a display. When traffic or weather information arrives, the service provider will compare the information with a database of commuter preselected routes and transmit the information to the mobile traffic pager of each affected subscribing commuter. Each mobile traffic pager visually presents the information on the display. After being notified of the actual or potential problem, each subscribing commuter may alter his preselected route to avoid any congestion that may result from the traffic or weather conditions.

The use of mobile traffic pagers, however, currently suffers from a critical disadvantage. When traffic or weather information arrives, the mobile traffic pager displays the information visually, requiring the driver to divert his attention from the road and the surrounding traffic. The commuter then must refocus on the mobile traffic pager and examine the display to determine which information is new as well as the location, type, and severity of the problem.

In view of the foregoing, it is believed that a need exists for an enhanced audible traffic paging system that overcomes the aforementioned obstacles and deficiencies of currently available mobile traffic pagers.

SUMMARY OF THE INVENTION

The present invention is directed to a wireless messaging system providing audible real-time, route-specific information, including traffic and weather conditions. Through the use of the present invention, a commuter can receive information regarding changing weather conditions as well as actual or potential traffic problems along his preselected route and avoid any resulting traffic congestion. The present invention thereby provides the advantage of presenting the commuter with real-time, route-specific information without requiring the commuter to divert his attention from the road and the surrounding traffic.

A traffic paging system in accordance with the present invention may comprise a route-entry system, a receiver system, an audio system, a transmit encoder system, an automated traffic incident-to-audio message assembly, and a paging terminal. The route-entry system preferably allows a commuter to specify at least one preselected route. The receiver system may be coupled to the route-entry system and may receive real-time traffic or weather information. The receiver system preferably selects relevant real-time information from a set of information broadcast by the transmit encoder system that is specific to one or more of the preselected routes and converts the relevant portion of the real-time information into sound information. The audio system, which is coupled to the receiver system, audibly presents the transmit encoder information to the driver.

It will be appreciated that a traffic paging system in accordance with the present invention may serve to alleviate a primary safety concern regarding the use of current mobile traffic pagers. As presently used, mobile traffic pagers visually provide traffic and weather information using built-in displays. The commuter, as a result, must examine the traffic pager and its display to discover the information, distracting the commuter's attention from the road and the surrounding traffic. In contrast, traffic paging systems of the present invention include an audio system that permits the commuter to learn new traffic and weather information without being distracted from the road. Thereby, commuters can more safely receive real-time information that is relevant to their preselected routes.

DETAILED DESCRIPTION OF THE PREFERRED EMBODIMENTS

Figure 1:
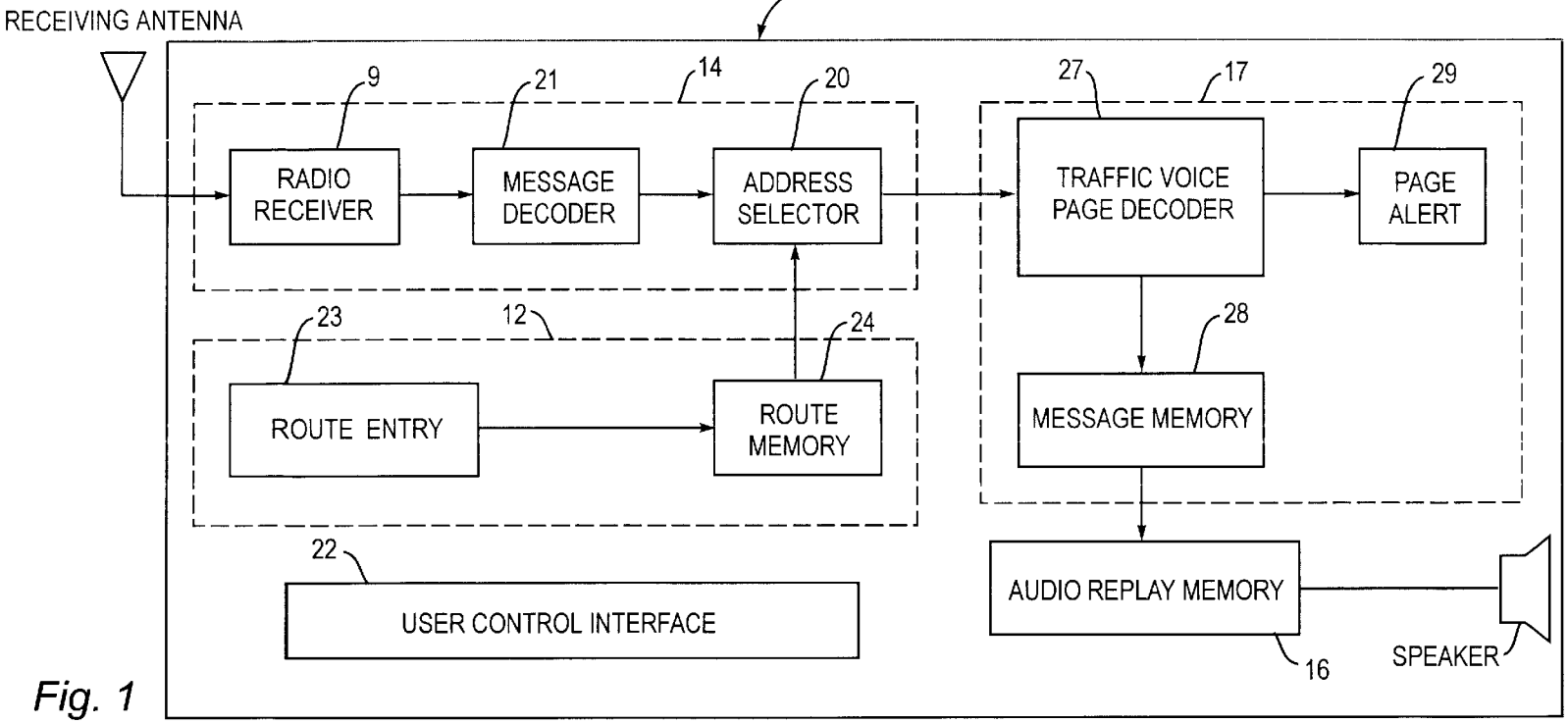
FIG. 1 is an illustration of one preferred embodiment of a traffic paging system in accordance with the present invention.

Since diverting a commuter's attention from the road and surrounding traffic presents a serious safety concern, the commuter is audibly presented with real-time information regarding weather and traffic conditions. This result may be achieved, according to one embodiment of the present invention, by employing a traffic paging system 10 as shown in FIG. 1. The traffic paging system 10 may include a traffic voice pager 11 having a route entry system 12, a receiver system 14, an audio replay system 16, and traffic voice page decoding system 17. The route entry system 12 preferably provides the commuter with the ability to specify one or more preselected routes (not shown) and may comprise a map (not shown) divided into a plurality of traffic zones. The commuter may specify the preselected routes, which may comprise any route that the commuter may take to any destination, including work, school, or elsewhere, by selecting one or more of the traffic zones. The route entry system 12 associates each traffic zone with a unique pager address. A traffic voice page corresponding to real-time information about traffic or weather within a given traffic zone will have a pager address unique to that given traffic zone. Based upon the desired preselected route a commuter has selected, the commuter uses the route entry system to select the appropriate traffic zones. The route entry system then identifies the pager addresses associated with the selected traffic zones. By audibly playing the voice traffic pages identified through the pager addresses, the traffic voice pager 11 informs the commuter about traffic conditions without distracting the commuter from the road.

The receiver system 14 is coupled to the route entry system 12 and may include a radio receiver 9, an address selector 20, and a message decoder 21. The radio receiver 9 receives traffic voice pages. The traffic voice pages may comprise information such as alpha/numeric pages, voice pages or weather or traffic condition, including potential or actual traffic problems. For example, the traffic voice page preferably includes a description of a type, a location, duration, extent, directional flow effected and severity of the weather or traffic condition. When the radio receiver 9 receives the traffic voice pages, the message decoder 21 decodes data/network codes and pager addresses associated with the traffic voice pages.

An address selector 20 selects traffic voice pages that have pager addresses identified by the route entry system 12, forwarding the selected traffic voice pages to the conversion unit 17. The conversion unit 17 decodes the selected traffic voice pages into a decoded traffic voice page, stores the decoded traffic voice page in message memory 28, preferably in a compressed form, and notifies the user of the presence of a stored decoded traffic voice page using a page alert 29. The page alert 29 may utilize a "beeper," vibrator, or visual means to notify the user. An audio system 16 coupled to the conversion unit 17 retrieves a stored decoded traffic voice page from the message memory 28, decompresses the message if applicable and audibly presents the audio information 26 to the commuter.

Figure 2:
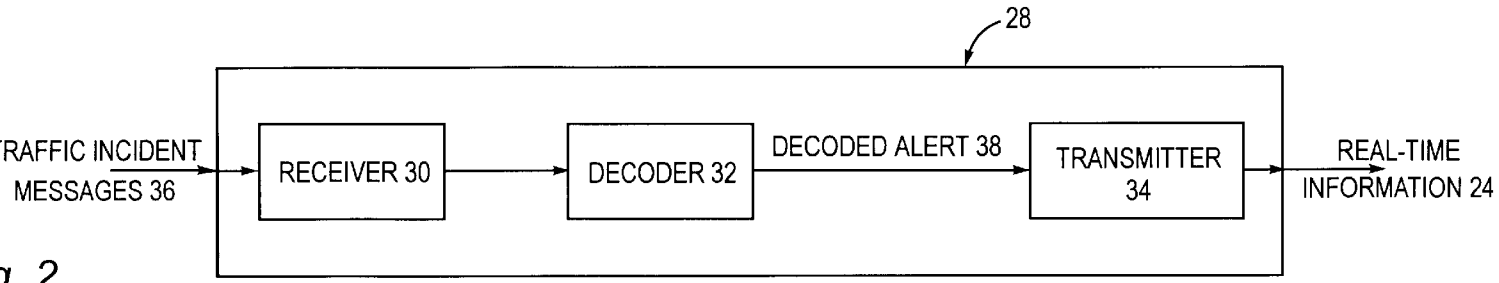
FIG. 2 is an illustration of a second preferred embodiment of a traffic paging system in accordance with the present invention.

In a second embodiment, the traffic paging system 10 may further include a transmit encoder system 28, as shown in FIG. 2. This system 28 receives traffic incident messages 36 and, after appropriate coding, transmits the traffic voice pages. The system 28 includes a receiver 30, a decoder 32, and a transmitter 34. The receiver 30 may receive one or more traffic incident messages 36 from, for example, an external source, such as a commercial traffic information provider, a news broadcast, or a report over an emergency service radio frequency. Alternatively, an operator of a traffic paging service may generate its own traffic information by, for example, chartering one or more helicopters or airplanes to fly over preselected areas and to provide information regarding the preselected areas. The traffic incident messages 36 may include information such as a weather or traffic condition, including potential or actual traffic problems. The traffic incident messages 36 preferably include a description of a type, a location, duration, extent, direction of flow effected and/or a severity of the weather or traffic condition.

The traffic incident messages 36 may be encoded under, for example, the Data Radio Channel (DARC) System standard, the Radio Data System Traffic Message Channel (RD-STMC) standard, or any other radio standard. The decoder 32 couples to the receiver 30 and preferably extracts a decoded alert 38 from each of the traffic incident messages 36. Each decoded alert 38 preferably includes a textual description (not shown) of each respective encoded alert 36. Afterward, each decoded alert 38 is preferably broadcasted as coded traffic voice pages 24 by the transmitter 34 coupled to the decoder 32, and then received by the receiver 9 of the traffic pager 11.

Figure 3:
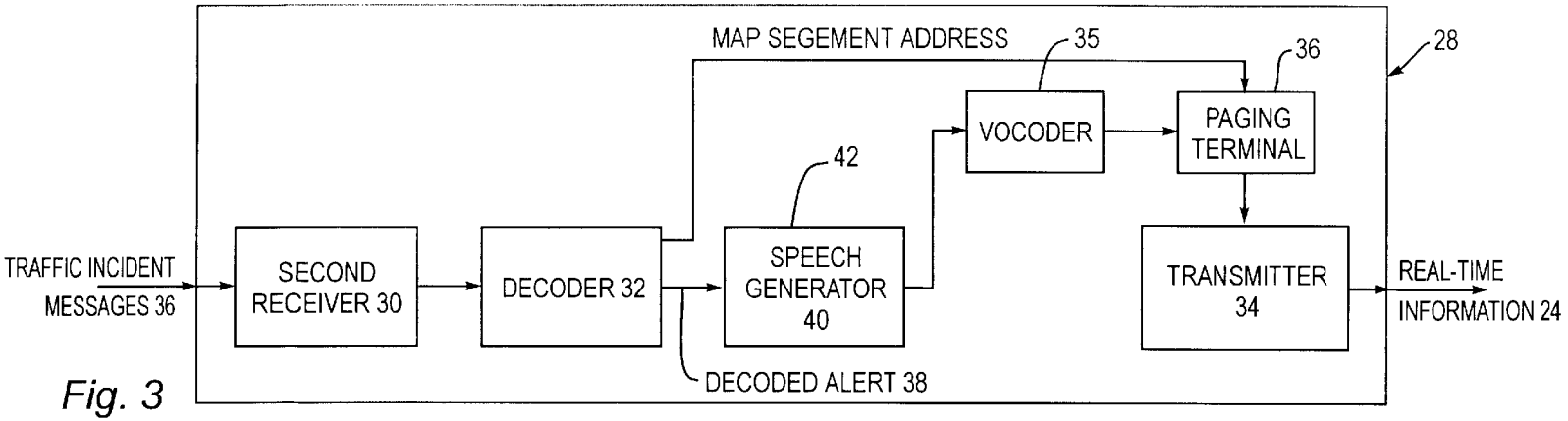
FIG. 3 is an illustration of an alternative construction of the traffic paging system shown in FIG. 2.

As shown in FIG. 3, preferably, the transmitter system 28 of the traffic paging system 10 may further include a speech generator 40 for converting each decoded alert 38 into speech information 42, and then converted to compressed speech by vocoder 35 and passed to paging terminal 36 to create a properly addressed traffic voice page. Said address is desired by paging terminal 36 from decoded traffic incident location data by decoder 32. Alternatively, the speech generator 38 may be provided in the conversion unit 17 of the traffic pager 11 where, in one embodiment, textual traffic incident reports are converted to synthetic speech (sic. Text-to-Speech) by methods well-known to those knowledgeable in the state-of-the-art. Within the transmitter system 28, the speech generator 40 may be disposed between, and coupled to, the decoder 32 and the transmitter 34 and may permit each decoded alert 38 to pass through to the transmitter 34. For each decoded alert 38, the traffic voice page preferably substantially comprises the decoded alert 38 and the speech information 42 generated from the decoded alert 38.

The speech generator 40 may comprise, for example, a speech synthesizer (not shown). An input of the speech synthesizer may be coupled to the decoder 32 and may receive each decoded alert 38. The speech synthesizer preferably will convert the textual description within each decoded alert 38 into the speech information 42, and an output of the speech synthesizer may be coupled to the transmitter 34 and may provide the speech information 42 to the transmitter 34.

Figure 4:
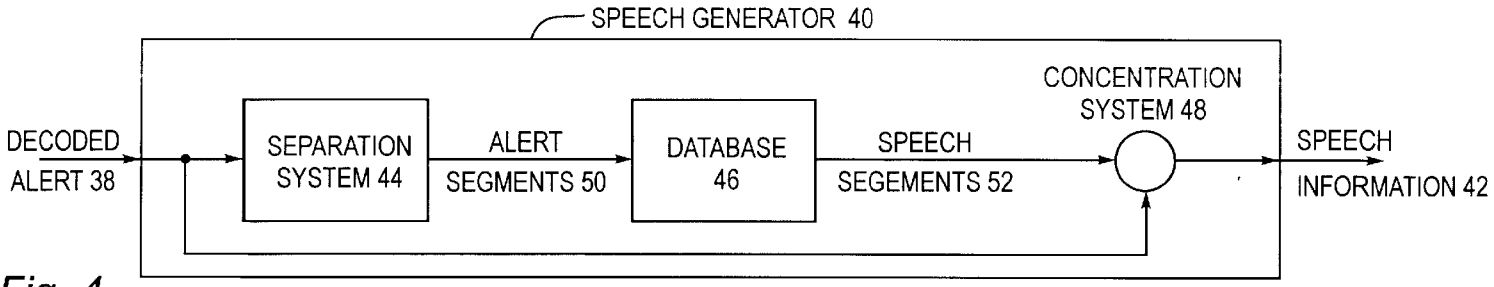
FIG. 4 is an illustration of a detailed view of the traffic paging system shown in FIG. 3.

Alternatively, the speech generator 40 may comprise a separation system 44, a database 46, and a concatenation system 48, as shown in FIG. 4. The separation system may be coupled to the decoder 32 and preferably separates each decoded alert 38 into a sequence of one or more prerecorded traffic message voice segments 50, each comprising a phrase of one or more words. The database 46 may be coupled to the separation system 44 and may receive the one or more alert segments 50 from the separation system 44. The database 46 preferably substantially comprises a plurality of prerecorded speech files (not shown). Each prerecorded speech file may substantially comprise the spoken words of the associated phrase and may be stored in any file format, including WAV sound or audio files, compressed WAV sound or audio files, MIDI sound or audio files, or MP3. Very preferably, each prerecorded speech file comprises words spoken with a human voice. After receiving one of the phrases, the database 46 preferably responds by producing a speech segment 52 that may substantially comprise the prerecorded speech file associated with the phrase. Therefore, when the database 46 receives the sequence of one or more alert segments 50, the database 46 may respond with a sequence of one or more speech segments 52. The concatenation system 48 may be coupled to the database 46 and may receive the sequence of one or more speech segments 52 from the database 46. The concatenation system 48 preferably concatenates the sequence of one or more speech segments 52, in order, onto the decoded alert 38, substantially reproducing the textual description of the decoded alert 38 in speech.

Figure 5:
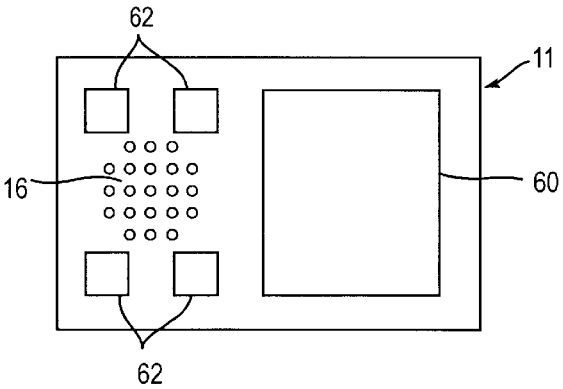
FIG. 5 is a detailed view of a traffic pager of a traffic paging system in accordance with the present invention.

The traffic pager 11 preferably is mobile, as shown in FIG. 5. The traffic pager 11 may be handheld or mounted in a vehicle (not shown) such as a car, truck, or any other type of vehicle. The route entry system 12 of the traffic pager 11 may include one or more switches 62. The one or more switches 62 may comprise one or more separate pushbuttons, a keypad, or any other type of electrical or mechanical switch. The route entry system 12 may further include a storage media 64 (as shown in FIG. 1) for storing and/or recalling the preselected routes. The storage media 64 may store and/or the recall preselected routes entered by the commuter and/or preprogrammed routes to one or more preprogrammed destination, such as an airport, a ballpark, a shopping center and/or another city. The audio system 16 may comprise a electromagnetic speaker, a piezo-electric speaker, or any other type of speaker or audio device. The traffic pager 11 may further include a display 60 for visually presenting the relevant portion 25 of the real-time information 24. The display 60 may visually present the characteristics the relevant portion 25 with text and/or with at least one icon (not shown). For example, the display 60 may indicate the nature, location, and severity of the relevant portion 25 of the real-time information.

While the invention is susceptible to various modifications and alternative forms, specific examples thereof have been shown by way of example in the drawings and are herein described in detail. It should be understood, however, that the invention is not to be limited to the particular forms or methods disclosed, but to the contrary, the invention is to cover all modifications, equivalents, and alternatives falling within the spirit and scope of the appended claims.

What is claimed is:

1. A traffic paging system for audibly disseminating traffic voice pages, comprising a traffic voice pager, the traffic voice pager including:

a route-entry system for specifying pager addresses associated with a preselected route;

a radio receiver for receiving traffic voice pages;

a message decoder coupled to the radio receiver for decoding pager addresses associated with the traffic voice pages;

an address selector coupled to the message decoder and route-entry system for selecting traffic voice pages associated with specified pager addresses;

a traffic voice page decoder coupled to the address selector for decoding and storing selected traffic voice pages in a message memory; and an audio replay system coupled to the message memory for audibly presenting stored selected traffic voice pages.

2. The traffic paging system of claim 1 further comprising a transmit encoder system, said transmit encoder system having a receiver for receiving at least one encoded alert, a decoder for extracting a decoded alert from each of said at least one encoded alert, and a transmitter for transmitting the traffic voice pages.

3. The traffic paging system of claim 2 wherein said decoded alert includes a textual description of said at least one encoded alert.

4. The traffic paging system of claim 2 wherein said at least one encoded alert is provided by an external source.

5. The traffic paging system of claim 2 wherein said transmit encoder system includes a speech generator for generating speech information from each of said at least one encoded alert, and the traffic voice pages further comprise said speech information, said speech generator being coupled to said decoder and being coupled to said transmitter.

6. The traffic paging system of claim 5 wherein said speech generator comprises a speech synthesizer.

7. The traffic paging system of claim 5 wherein said speech generator comprises a separation system for separating said decoded alert into a sequence of at least one alert segment, a database for converting said sequence of at least one alert segment into a sequence of at least one speech segment, and a concatenation system for concatenating said sequence of at least one speech segment onto said decoded alert, said separation system being coupled to said decoder, said database being coupled to said separation system and substantially comprising a plurality of prerecorded speech files, said at least one alert segment each comprising at least one word.

8. The traffic paging system of claim 7 wherein said plurality of prerecorded speech files each substantially comprises a human voice.

9. The traffic paging system of claim 7 wherein said plurality of prerecorded speech files each substantially comprised of a WAV sound file.

10. The traffic paging system of claim 7 wherein said plurality of prerecorded speech files each substantially comprised of a compressed WAV sound file.

11. The traffic paging system of claim 7 wherein said plurality of prerecorded speech files each substantially comprised of a MIDI sound file.

* * * * *